United States Patent [19]

Magdesyan et al.

[11] Patent Number: 4,775,331

[45] Date of Patent: Oct. 4, 1988

[54] BATTERY TERMINAL POST ELECTRICAL CONNECTOR

[76] Inventors: Garnik Magdesyan; Stepan Magdesyan; Hakop Magdesyan, all of 112 N. 18th St., Montebello, Calif. 90640

[21] Appl. No.: 44,763

[22] Filed: May 1, 1987

[51] Int. Cl.[4] ..... H01R 13/40

[52] U.S. Cl. ..... 439/593; 439/759; 439/522

[58] Field of Search ..... 439/388, 725, 726, 754, 439/759, 760, 586, 588, 592, 593, 519, 521, 522, 523, 772, 755

[56] References Cited

U.S. PATENT DOCUMENTS

| | | | |
|---|---|---|---|
| 1,658,752 | 2/1928 | Wilford | 439/519 |
| 2,531,309 | 11/1950 | Thomas | 439/760 |
| 2,766,437 | 10/1956 | Ahlgren | 439/519 |
| 3,829,823 | 8/1974 | Dumesnil | 439/522 |
| 4,521,067 | 6/1985 | Dufresne | 439/726 |
| 4,576,430 | 3/1986 | Dufresne | 439/521 |
| 4,598,971 | 7/1986 | Goodman | 439/726 |

FOREIGN PATENT DOCUMENTS

| | | | |
|---|---|---|---|
| 716896 | 10/1954 | United Kingdom | 439/760 |

*Primary Examiner*—David Pirlot

*Attorney, Agent, or Firm*—Jack C. Munro

[57] ABSTRACT

An electrical connector for a battery terminal post which is utilized to establish a positive electrical connection between the post and an electrical conductor. The electrical conductor is fixedly mounted within the housing of the electrical connector. The housing is constructed of a stretchable material such as a rubber composition. The housing includes an enlarged opening to accommodate the terminal post. The housing is stretched over the terminal post with the inherent resiliency of the housing maintaining a tight electrical connection between the post and the conductor.

2 Claims, 1 Drawing Sheet

BATTERY TERMINAL POST ELECTRICAL CONNECTOR

BACKGROUND OF THE INVENTION

The field of this invention relates to clamps and more particularly to a new and novel boltless clamp for a battery terminal post.

The structure of this invention is basically similar to U.S. Pat. No. 4,695,118, issued Sept. 22, 1987, entitled BATTERY TERMINAL POST CLAMP, which includes the present inventor as one of the inventors.

The use of batteries to produce electrical power has long been known. Although batteries take numerous shapes, a common shape it s box-like housing which is composed of a plurality of cells connected together and having a positive and negative electrical connection on the upper surface of the battery housing. These positive and negative electrical connections are frequently termed "terminal posts". These types of batteries are generally rechargeable. Such batteries are frequently used in automobiles, trucks, earth moving equipment and other types of vehicles. Also, such types of batteries are used in stationary equipment such as generators and the like.

It is necessary to connect an electrical conductor to each terminal post of the battery. The most commonly used type of connection comprises an encircling clamp which is snugly mounted over a terminal post. This clamp is electrically connected to an electrical conductor which is to be usable to conduct electricity to electrically operated equipment. The clamp normally includes a bolt fastener assembly which is to be separately tightened for securing the clamp in position about the terminal post.

If it is necessary to replace the battery, these bolt fasteners must be loosened to permit disengagement of the clamps from each of the terminal posts of the battery. Also, it is generally advisable as normal maintenance procedure to periodically remove the clamps to clean both the clamps and the posts to avoid buildup of a corrosive layer which prevents the conducting of electricity from the terminal posts into the electrical conductor. At times this maintenance procedure needs to be performed at inconvenient locations such as alongside a roadway or at night. At such an inconvenient location, the individual may not readily have in his possession the necessary tools to loosen the bolt so that the clamp can be removed for the maintenance procedure. Also, at times the replacement of a battery needs to be accomplished at, again, an inconvenient location and the individual doing the replacement may not have the tools necessary to remove the clamps.

There has long been a need to improve the battery clamp which would permit the battery clamp to be atttached and detached from a battery terminal post without using any type of separate fasteners such as a bolt or screw.

SUMMARY OF THE INVENTION

The structure of the present invention is directed to a connector which is formed of a housing within is located an enlarged internal opening. The housing is constructed of a resilient stretchable material with generally a rubber type of composition being preferred. A battery terminal post is to be locatable in a snug fitting manner within this enlarged internal opening. Also, formed within the housing is an open ended elongated opening within which is to be located a section of an insulated electrical conductor. A section of the insulated electrical connector has been removed exposing the bare wires and this section tangentially connects with the enlarged internal opening and is to tightly abut against the terminal post. The housing is to be stretched to tightly engage about the terminal post. There may be located within the elongated opening a strip of rigid material to provide rigidity to further insure of a tight electrical connection between the electrical conductor and the post. If the electrical conductor terminates at the housing, the open end of the elongated opening is to be closed by a cap. The housing will normally include a flap which is to extend over and cover the upper end of the terminal post. A stretchable band may be utilized to connect between two separate housings with one housing to connect with one terminal post and the second housing to connect with a second terminal post.

The principle objective of the present invention is to construct a connector for a battery terminal post which can be operated by being merely inserted onto the post to tightly secure thereto achieving a direct positive connection between the terminal post and an electrical conducting wire without requiring the use of a separate fastener such as a bolt.

Another objective of the present invention is to construct a connector for a battery terminal post which minimizes periodic maintenance.

Another objective of this invention is to construct a connector which can be manufactured inexpensively and therefore sold inexpensively to the consumer.

DETAILED DESCRIPTION OF THE SHOWN EMBODIMENT

Figure 1:
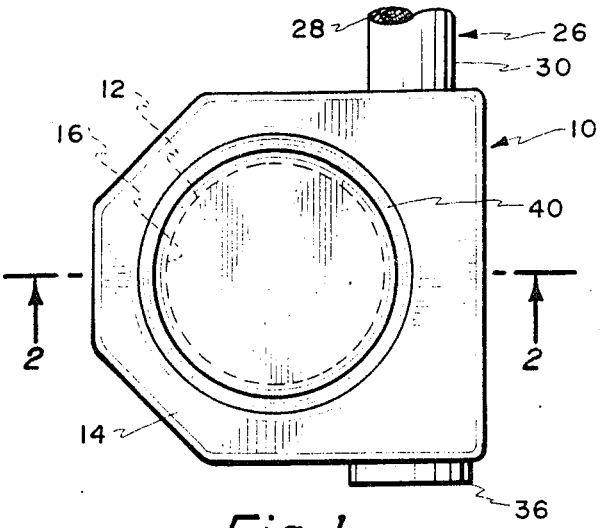
FIG. 1 is a top plan view of the battery terminal post electrical connector of this invention showing the electrical connector in position on a battery terminal post.
Figure 3:
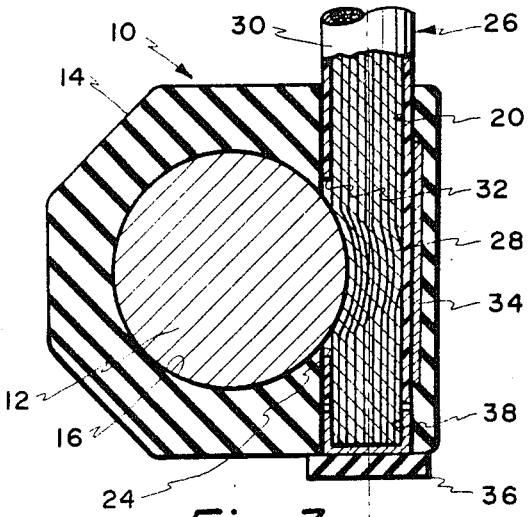
FIG. 3 is a cross-sectional view taken along line 3—3 of FIG. 2.

Referring particularly to the drawing, there is shown the battery terminal post electrical connector 10 of this invention which is to be securely mounted onto a conventional battery terminal post 12. The battery terminal post 12 is mounted on the top surface of a conventional battery (not shown). The battery terminal post is constructed of electrically conductive material.

The battery terminal post electrical connector 10 is constructed primarily of a housing 14. This housing 14 is composed entirely of a material which is slightly stretchable. A preferable type of material would be a rubber composition.

Within the housing 14 is located an enlarged opening 16. The opening 16 has a longitudinal center axis 18.

Figure 2:
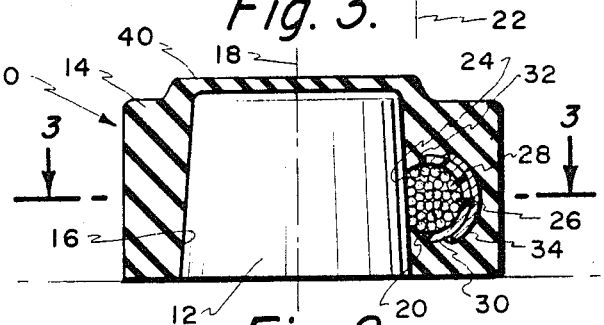
FIG. 2 is a cross-sectional view taken along line 2—2 of FIG. 1.
Figure 4:
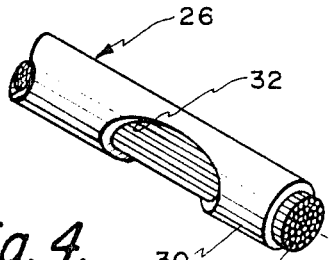
FIG. 4 is an exploded isometric view of the battery terminal post electrical connector of this invention.

The wall surface of the opening 16 is slightly tapered to matingly conform to the slightly tapered surface of the terminal post 12. This tapering is clearly shown in FIG. 2 of the drawing. The actual physical cross-sectional size of the opening 16 is slightly less than the cross-sectional size of the post 12. Therefore, in order to locate the post 12 within the opening 16, it is required that the housing 14 assume a slightly stretched configuration. As a result, when the housing 14 is located on the post 12, the housing 14 will be tightly pressed in contact with the post 12 and be securely retained on the post 12 without the need of any additional securing devices such as bolts.

Also formed within the housing 14 is an elongated opening 20. This opening 20 is open ended and has a longitudinal center axis 22. It is noted that the axis 22 is located perpendicular to the axis 18 but is spaced from the axis 18. This spacing is such that a portion of the opening 20 connects with the opening 16 forming connecting opening 24. In essence, the opening 20 connects with the opening 16 in a tangential manner.

An electrical conductor 26 is to be snugly retained within the opening 20. The electrical conductor 26 is formed of a mass of electrically conducting wires 28 which are covered by an insulating sheath 30. A portion of the sheath 30 is removed forming cutout 32. This cutout 32 exposes the wires 28. This cutout 32 is to be aligned with the connecting opening 24. Therefore, when the housing 14 is installed on the post 12, it can be readily seen from the drawing that the post 12 is pressed tightly into physical contact with the wires 28 forming a direct electrical connection therebetween.

It may be desirable to increase the rigidity of the opening 20, that is keep the axis 22 as straight as possible. This rigidity will further insure a positive electrical connection between the post 12 and the wires 28. In order to achieve this rigidity, it is only necessary to insert a half-circle configuration metallic strip 34 within the opening 20. The strip 34 is located diametrically opposite the connecting opening 24.

It is considered to be within the scope of this invention that the electrical conductor 26 need not terminate within the housing 14 but may continue from the housing 14 to a second terminal post electrical connector (not shown). However, if the electrical conductor 26 does terminate within the housing 14, it will normally be desired to close the open end of the wires 28 and prevent air from entering into the area of the electrical connection between the post 12 and the wires 28. In order to close off the bare end of the wires 28, there will be utilized a cap 36. Normally, the cap 36 will be constructed of a plastic or rubber material. This cap 36 will be merely press fitted within the open end of the opening 20 with the end of the wires 28 extending within interior compartment 38 of the cap 36.

Also, the housing 14 will normally include a flap 40. The flap 40 will be integrally connected to the housing 14 and will abut against the top surface of the post 12. The function of the flap 40 is to prevent air from seeping into the area of the electrical connection between the post 12 and the wires 28 in order to prevent corrosion therebetween.

Figure 5:
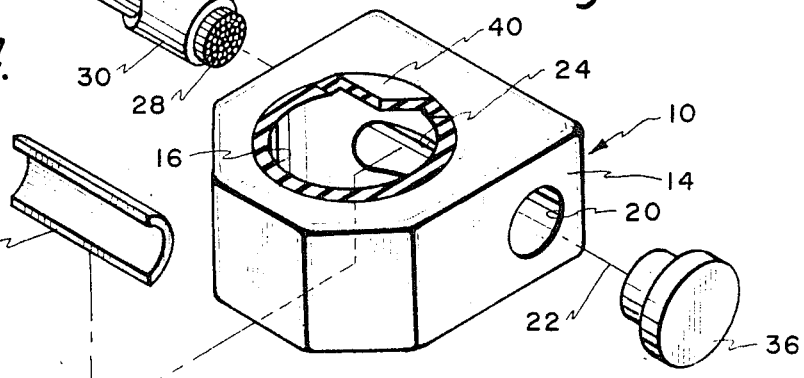
FIG. 5 is a view depicting the use of a stretchable band connected between a pair of battery terminal post electrical connectors of this invention showing the band in a non-stretched state.
Figure 5:
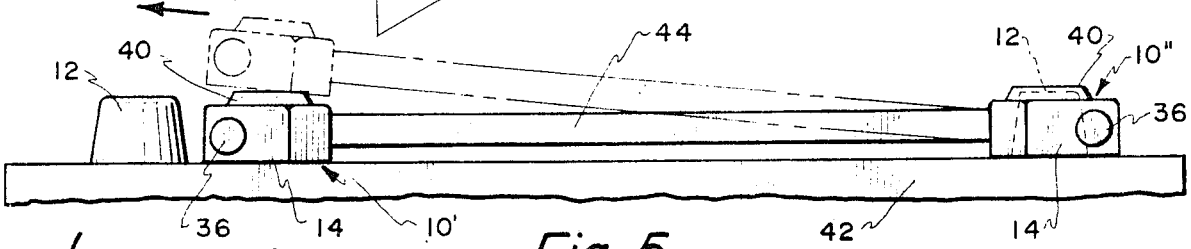
Figure 6:
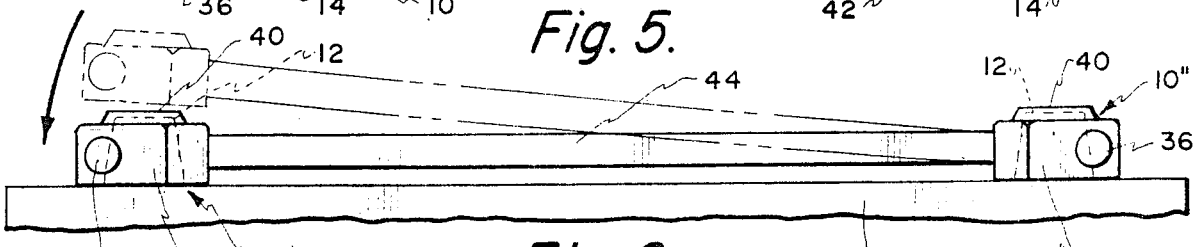
FIG. 6 is a view similar to FIG. 5 but showing the band in a stretched configuration with both battery terminal post electrical connectors connecting with the battery terminal posts.

Most batteries, such as battery housing 42 shown in FIGS. 5 and 6, have mounted thereon two terminal posts 12. These posts 12 are located in a spaced apart relationship. A battery terminal post electrical connector 10' will be required to connect with a one post 12 with the second battery post electrical connector 10'' connecting with the remaining battery terminal post 12. These battery terminal post electrical connectors 10' and 10'' are identical to the battery terminal post electrical connector 10. It may be found to be preferable to connect together the battery terminal posts 10' and 10'' by a resilient stretchable band 44. The at-rest position of the band 44 is shown in FIG. 5 and when the band 44 is stretched a certain amount the connector 10' can be installed with its post 12 when previously the connector 10'' had been installed in connection with its post 12. Not only does the band 12 connect together the two connectors 10' and 10'', the band 44 also functions to apply a resilient pulling force to each connector housing 14. This pulling force tends to further insure a positive electrical connection between each post 12 and the wires 28 of its respective electrical conductor 26.

What is claimed is:

1. In combination with a battery terminal post, a battery terminal post electrical connector comprising:

a housing, the entire said housing being constructed of a rubber material, said housing being stretchable;

an enlarged opening formed within said housing, said enlarged opening having a first longitudinal center axis, the cross-sectional size of said enlarged opening being smaller than the cross-sectional size of said post prior to connection with said post, said post to be located within said enlarged opening by stretching of said housing thereby creating a tight fit between said post and said housing, said post to be in direct contact with said housing;

an elongated opening formed within said housing, said elongated opening having a second longitudinal center axis, said longitudinal center axis being substantially perpendicular to said first longitudinal center axis but spaced therefrom, said elongated opening being open ended, said elongated opening tangentially connecting with said enlarged opening;

an electrical conductor to be located within said elongated opening, said electrical conductor electrically connecting with said battery terminal post;

said electrical conductor being covered by an electrically insulating sheath, a portion of said sheath being removed, a thus exposed conductor portion communicating with said enlarged opening; and a rigid sheet material member located within said elongated opening, said electrical conductor being located between said rigid sheet material member and said post, said rigid sheet material member to provide rigidity to said elongated opening and assist in holding said electrical conductor in tight engagement with said post, said rigid sheet material member being in the form of a strip and contacts only said sheath directly adjacent to said removed portion.

2. The battery terminal post electrical connector as defined in claim 1 wherein:

said battery terminal post electrical connector including a pair of said housings located in a spaced apart manner, a stretchable band integrally connected between said housings.

* * * * *